US011350734B2

(12) United States Patent
Clores

(10) Patent No.: US 11,350,734 B2
(45) Date of Patent: Jun. 7, 2022

(54) FOLDING PORTABLE DESK AND METHOD THEREFOR

(71) Applicant: Edgardo Clores, Las Vegas, NV (US)

(72) Inventor: Edgardo Clores, Las Vegas, NV (US)

( * ) Notice: Subject to any disclaimer, the term of this patent is extended or adjusted under 35 U.S.C. 154(b) by 0 days.

(21) Appl. No.: 17/024,539

(22) Filed: Sep. 17, 2020

(65) Prior Publication Data

US 2021/0085071 A1 Mar. 25, 2021

Related U.S. Application Data

(60) Provisional application No. 62/902,805, filed on Sep. 19, 2019.

(51) Int. Cl.

| | |
|---|---|
| ***A47B 3/08*** | (2006.01) |
| ***A47B 13/16*** | (2006.01) |
| ***A47B 3/10*** | (2006.01) |
| *A47B 3/00* | (2006.01) |

(52) U.S. Cl.

CPC ..... *A47B 3/0818* (2013.01); *A47B 3/10* (2013.01); *A47B 13/16* (2013.01); *A47B 2003/008* (2013.01)

(58) Field of Classification Search

CPC .. A47B 31/06; A47B 3/10; A47B 5/00; A47B 5/06; A47B 23/041; A47B 83/045

USPC ..... 108/43, 44, 35, 38, 34

See application file for complete search history.

(56) References Cited

U.S. PATENT DOCUMENTS

| | | | | | |
|---|---|---|---|---|---|
| 4,378,828 | A * | 4/1983 | Shiminski | B25H 1/04 | 108/35 |
| 4,483,427 | A * | 11/1984 | Gerch | A45C 3/02 | 190/11 |
| 5,115,893 | A * | 5/1992 | Terkildsen | A45C 3/02 | 190/102 |
| 5,265,541 | A * | 11/1993 | Gordon | A47B 3/10 | 108/34 |
| 5,598,786 | A * | 2/1997 | Patterson | A47B 23/001 | 108/43 |
| 5,660,117 | A * | 8/1997 | Noble | A47B 23/043 | 108/35 |
| 5,833,200 | A * | 11/1998 | Patterson | A47B 23/002 | 248/456 |
| 6,050,200 | A * | 4/2000 | Sullins | A47B 23/002 | 108/25 |
| 6,152,417 | A * | 11/2000 | Randall | A47B 23/001 | 108/43 |
| 7,055,442 | B2 * | 6/2006 | Podd | A47B 23/001 | 108/25 |
| D588,373 | S * | 3/2009 | Rushton | D6/406.6 | |
| 8,424,464 | B2 * | 4/2013 | Korpi | A47B 23/044 | 108/9 |
| 8,528,489 | B2 * | 9/2013 | Roy | A47B 13/003 | 108/125 |
| 8,635,959 | B1 * | 1/2014 | Silknitter | A47G 23/0608 | 108/43 |

(Continued)

*Primary Examiner* — Jose V Chen

(74) *Attorney, Agent, or Firm* — Weiss & Moy, P.C.; Jeffrey D. Moy

(57) ABSTRACT

A foldable portable organizer desk has a base member having a flat front surface. A pair of leg members is hingely coupled to a rear surface of the base member. A folding member is hingely coupled to the base member. A folding member recessed area is formed in an interior surface of the folding member. At least one holding container is formed in the recessed area.

14 Claims, 5 Drawing Sheets

(56) References Cited

U.S. PATENT DOCUMENTS

| | | | | |
|---|---|---|---|---|
| 8,991,319 | B2 * | 3/2015 | Korpi | B64D 11/0638 108/44 |
| 2002/0069793 | A1 * | 6/2002 | Clores | A47B 17/00 108/35 |
| 2003/0160145 | A1 * | 8/2003 | Prior | A47B 85/00 248/461 |
| 2005/0211138 | A1 * | 9/2005 | Gupta | D03D 15/69 108/43 |
| 2007/0151487 | A1 * | 7/2007 | Villapanda | A47B 23/043 108/43 |
| 2008/0072802 | A1 * | 3/2008 | de Oliveira | A47B 3/10 108/12 |
| 2008/0083351 | A1 * | 4/2008 | Lippert | A47B 3/10 108/44 |
| 2008/0149802 | A1 * | 6/2008 | Chiang | A47B 3/10 248/461 |
| 2009/0265050 | A1 * | 10/2009 | Burpee | A47B 23/002 701/16 |
| 2011/0017563 | A1 * | 1/2011 | Azi | A45C 9/00 190/11 |
| 2011/0056412 | A1 * | 3/2011 | Grammer | A45C 9/00 108/6 |

* cited by examiner

FOLDING PORTABLE DESK AND METHOD THEREFOR

RELATED APPLICATIONS

This patent application is related to U.S. Provisional Application No. 62/902,805 filed Sep. 19, 2019, entitled "FOLDING PORTABLE DESK AND METHOD THEREOF" in the name of Edgardo Clores, and which is incorporated herein by reference in its entirety. The present patent application claims the benefit under 35 U.S.C. § 119(e).

TECHNICAL FIELD

The present application generally relates to a desk and, more particularly, to a foldable, organizer desk which may be easily carried and transportable by a child and which may be easily unfolded and used in any location by the child even in a moving vehicle.

BACKGROUND

These days, children are always on the go. After school, most parents are busy taking their children to a multitude of different activities. Because of the child's busy schedule, many times, the child has to do homework while driving in a car, bus, or other moving vehicle. Other times, the child may have to do homework while waiting at a field for a sporting activity/practice such as baseball, softball, soccer, football or the like. During these times, a portable surface to use as a desk for reading and writing would be beneficial to the child. Unfortunately, most children do not have a highly portable, lightweight folding desk that they carry around. Because of this, most children generally use a hard surface such as a book, notebook or like object to write on.

Therefore, it would be desirable to provide a system and method that overcome the above problems. The system and method would provide a foldable desk which may be carried and transportable by a child and which may be unfolded and used in any location by the child even in a moving vehicle. The system and method would provide a foldable portable desk which may function as an organizer allowing the child an area to store items for use with using the foldable portable desk.

SUMMARY

In accordance with one embodiment, a foldable portable organizer desk is disclosed. The foldable portable organizer desk has a base member having a flat front surface. A pair of leg members is hingely coupled to a rear surface of the base member. A folding member is hingely coupled to the base member. A folding member recessed area is formed in an interior surface of the folding member. At least one holding container is formed in the recessed area.

In accordance with one embodiment, a foldable portable organizer desk is disclosed. The foldable portable organizer desk has a rectangular base member having a flat front surface. A pair of leg members is hingely coupled to a rear surface of the rectangular base member. A rectangular folding member is coupled to the rectangular base member. A hinge secures a rear edge of the rectangular folding member to a rear edge of the rectangular base member. A folding member recessed area is formed in an interior surface of the rectangular folding member. At least one holding container is formed in the folding member recessed area. A base member recessed area is formed on the rear surface of the rectangular base member, the pair of leg members attached within a bottom surface of the base member recessed area, wherein the pair of leg members filling the base member recessed area to form a smooth rear surface of the rectangular base member when the pair of leg members are folded up and stored within the base member recessed area.

In accordance with one embodiment, a foldable portable organizer desk is disclosed. The foldable portable organizer desk has a base member having a flat front surface. A pair of leg members is hingely coupled to a rear surface of the base member. A folding member is coupled to the base member, wherein the base member and the folding member have a same geometric shape and a same outer perimeter. A hinge secures a rear edge of the folding member to a rear edge of the base member. A folding member recessed area is formed in an interior surface of the folding member. At least one holding container is formed in the folding member recessed area. A base member recessed area is formed on the rear surface of the base member, the pair of leg members attached within a bottom surface of the base member recessed area, wherein the pair of leg members filling the base member recessed area to form a smooth rear surface of the base member when the pair of leg members are folded up and stored within the base member recessed area.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Embodiments of the exemplary portable desk provide a foldable, organizer desk which may be easily carried and transportable by a child. The foldable, organizer desk may be easily unfolded and used in any location by the child even in a moving vehicle.

Figure 1:
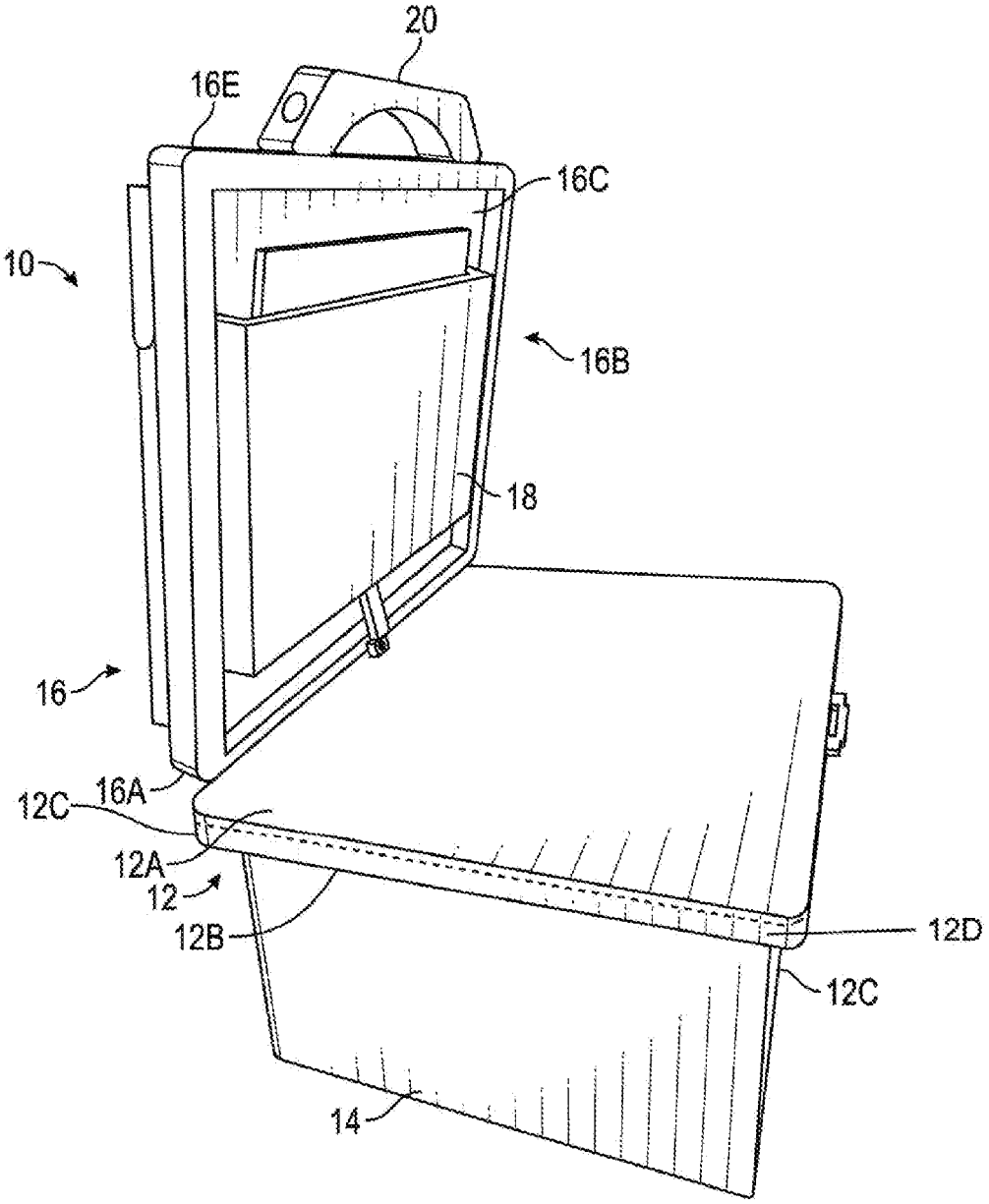
FIG. 1 is a side perspective view of an exemplary embodiment of a folding portable desk in an open position in accordance with one embodiment of the present invention.
Figure 2:
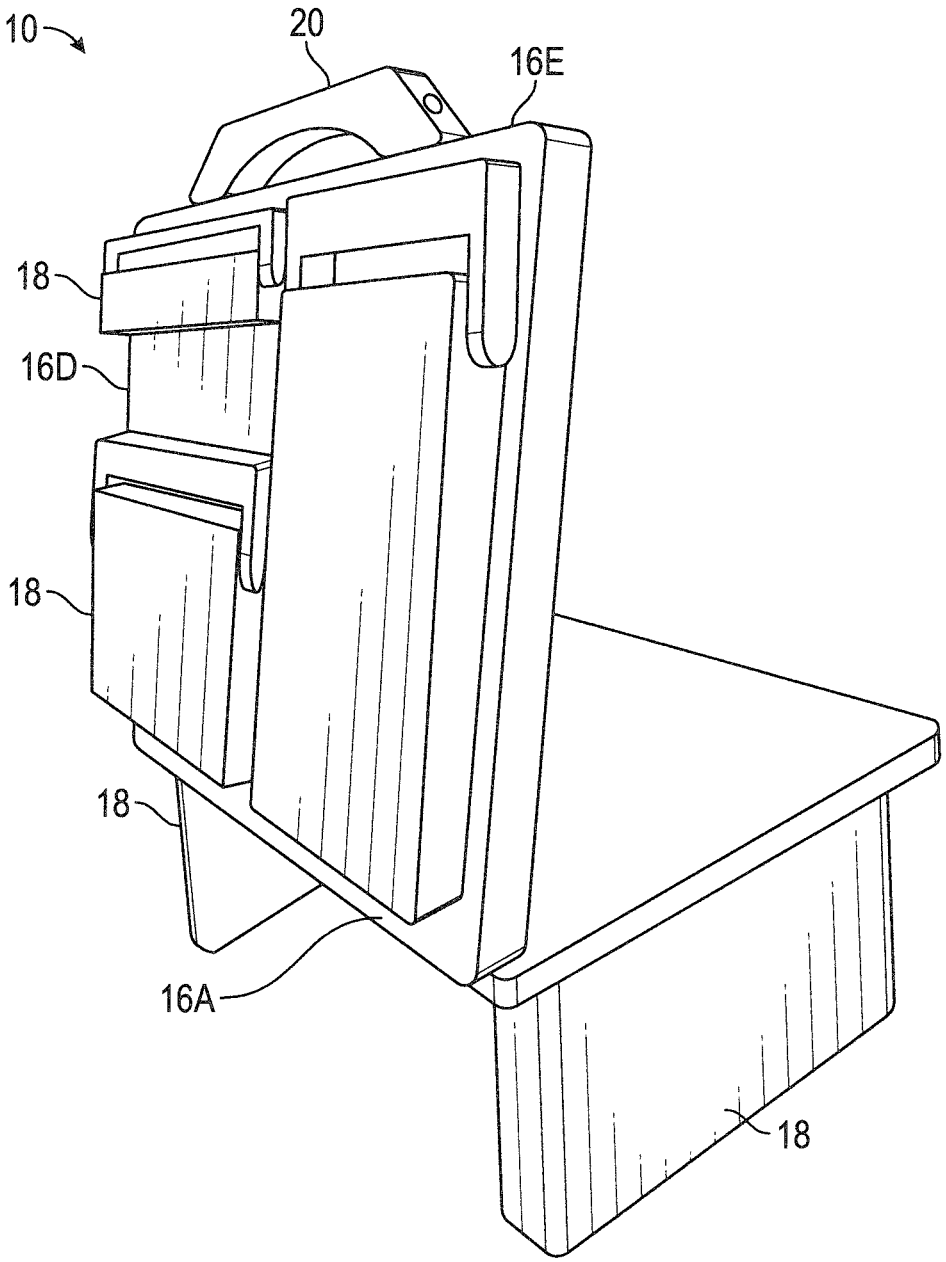
FIG. 2 is a rear view of an exemplary embodiment of a folding portable desk in an open position in accordance with one embodiment of the present invention.
Figure 3:
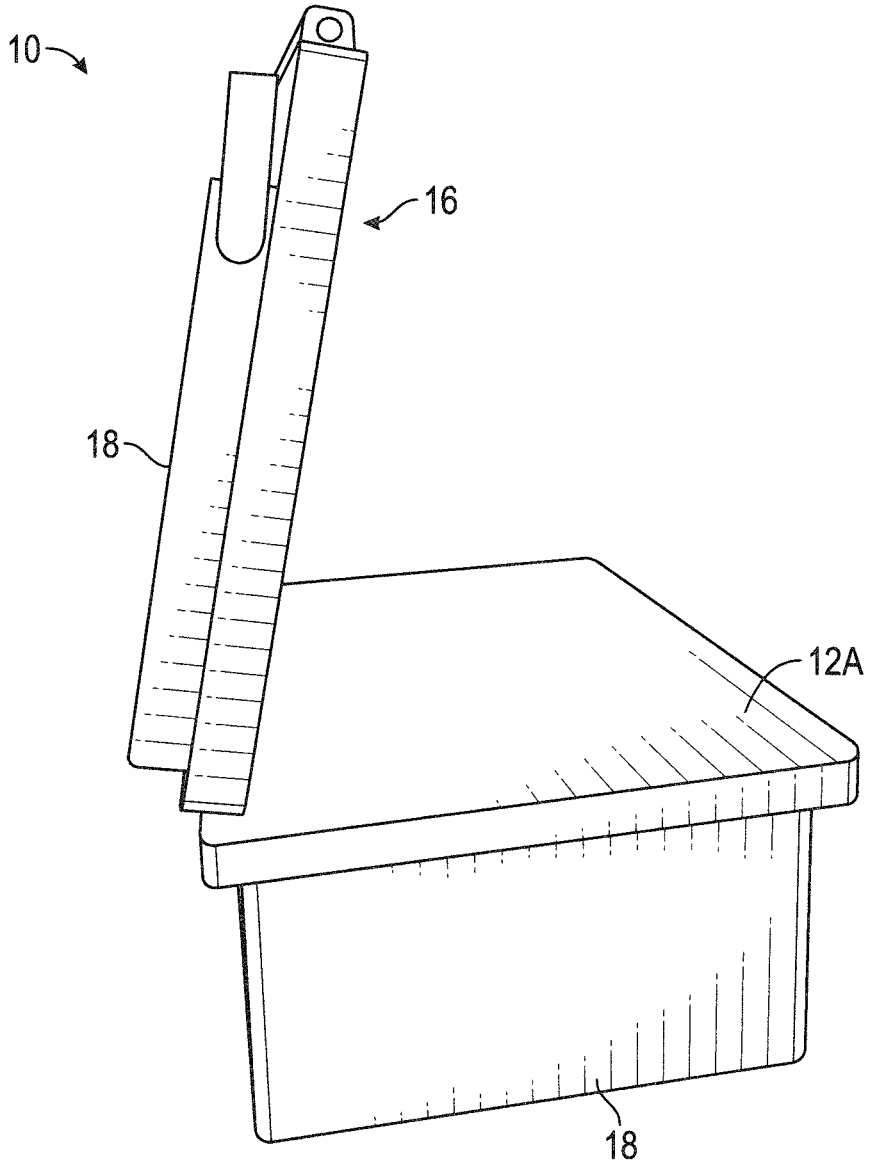
FIG. 3 is another side perspective view of an exemplary embodiment of a folding portable desk in an open position in accordance with one embodiment of the present invention.
Figure 4:
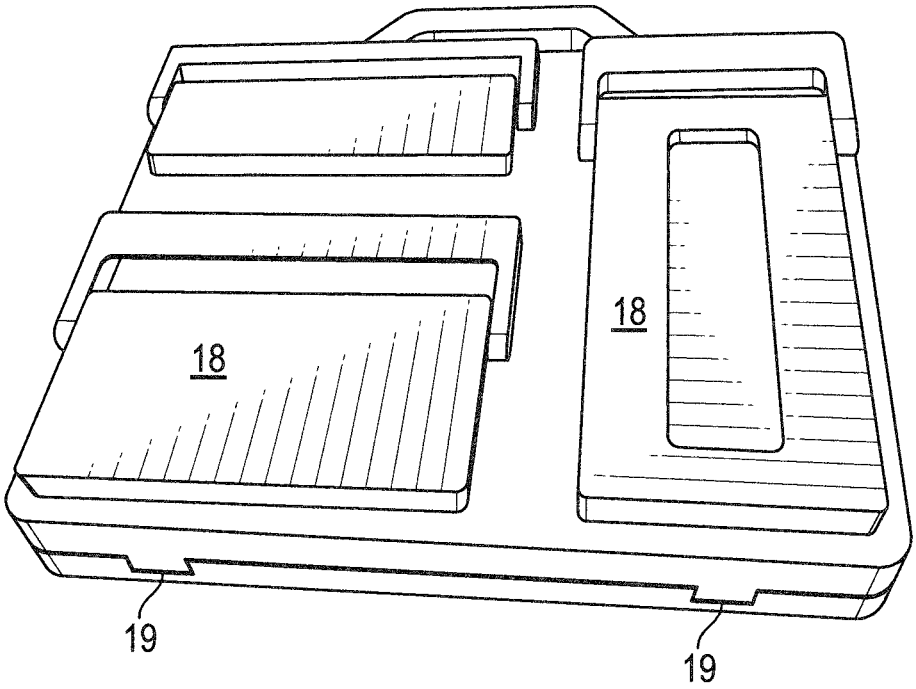
FIG. 4 is a top perspective view of an exemplary embodiment of a folding portable desk in a closed position in accordance with one embodiment of the present invention.
Figure 5:
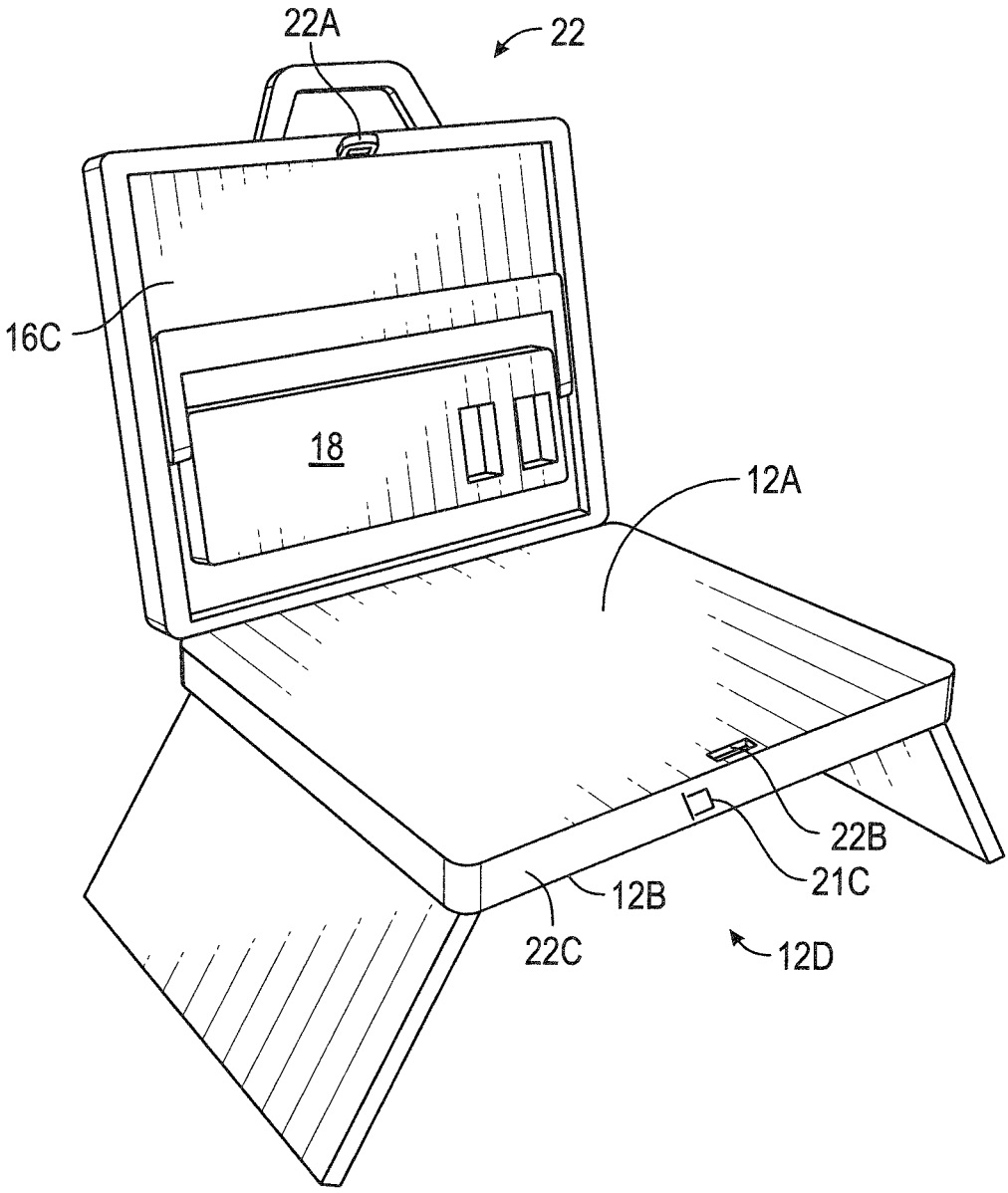
FIG. 5 is a perspective view of an exemplary embodiment of a folding portable desk in an open position in accordance with one embodiment of the present invention.

Referring now to the FIGs., a foldable desk 10 may be shown. The foldable desk 10 may have a base member 12. The base ember 12 may have a flat front surface 12A. The flat front surface 12A may be used as a writing surface or the like. A rear surface 12B may have a recessed area 12D formed therein. A pair of leg members 14 may be hingely coupled to the rear surface 12B. In accordance with one embodiment, the pair of leg members 14 may be hingely coupled to a bottom surface in the recessed area 12D. In one state, the pair of leg members 14 may be extended down as shown in FIGS. 1-3 and 5. The pair of leg members 14 may support the foldable desk 10 to allow one to write on the flat front surface 12A of the base member 12. In a second state, the pair of leg members 14 may be folded and up stored within the recessed area 12D of the rear surface 12B of the base member 12. When folded, the pair of leg members 14 fill the recessed area 12D to form a smooth rear surface 12B.

A folding member 16 may be hingely coupled to the base member 12. In the present embodiment, a rear edge 16A of the folding member 16 may be hingely to a rear edge 12C of the base member 12. One or more hinges 19 may be used to hingely couple the rear edge 16A of the folding member 16 to the rear edge 12C of the base member 12.

The folding member 16 may have a same outer perimeter size and shape of the base member 12. This may allow the folding member 16 to fold on top of the base member 12 and form a smooth outer perimeter for the foldable desk 10. In the present embodiment, the base member 12 and the folding member 16 may be rectangular in shape.

An interior side 16B of the folding member 16 may have a recessed area 16C. One or more storage containers 18 may be attached to the recessed area 16C. The storage containers 18 may be of a size to not extend out of the recessed area 16C but fit within the recessed area 16C. This may allow the folding member 16 to fold on top of the base member 12. The storage containers 18 may be used to store supplies to be used with the foldable desk 10. For example, the storage containers 18 may be used to store papers, writing instruments, toys, or other like items. The above is given as examples and should not be seen in a limiting manner. Other items may be placed within the storage containers 18.

An exterior side 16D of the folding member 16 may have one or more storage containers 18 attached thereto. The storage containers 18 may be used to store papers, writing instruments, toys, or other like items. The above is given as examples and should not be seen in a limiting manner. Other items may be placed within the storage containers 18 formed on the exterior side 16D of the folding member 16.

A handle 20 may be attached to a front edge 16E of the folding member 16. The handle 20 may be used to carry and transport the foldable desk 10. In accordance with one embodiment, the handle 20 may be hingely attached to the front edge 16E of the folding member 16.

The folding desk 10 may have a locking mechanism 22. The locking mechanism 22 may be used to secure the folding member 16 to the base member 12 when the folding member 16 is folded on top of the base member 12. As may be seen in FIG. 5, the locking mechanism 22 has a male member 22A, a female connector 228 and a release button 22C. In the present embodiment, the male connector 22A may extend down from a front edge of the interior side 168 of the folding member 16. The female connector 228 may be formed in a front edge area of the flat front surface 12A of the base member 12. When the folding member 16 is folded on top of the base member 12, the male member 22A may be secured within the female connector 22B locking the folding member 16 to the base member 12. The release button 22C may be formed along the front edge of the base member 12. Pressing the release button 22C releases the male connector 22A from the female connector 22B allowing one to raise the folding member 16.

The foregoing description is illustrative of particular embodiments of the application, but is not meant to be a limitation upon the practice thereof. The following claims, including all equivalents thereof are intended to define the scope of the application.

What is claimed is:

1. A foldable portable organizer desk, comprising:
- a base member having a flat front surface;
- a pair of leg members hingely coupled to a rear surface of the base member;
- a folding member hingely coupled to the base member;
- a folding member recessed area formed in an interior surface of the folding member;
- at least one holding container formed in the folding member recessed area; and
- a locking mechanism securing the folding member to the base member, wherein the locking mechanism comprises:
- a first locking member formed on a front interior area of the folding member, wherein the first locking member is a male connector;
- a second locking member formed on a front interior area of the base member, wherein the second locking member is a female connector; and
- a release button formed flush on a front edge of the base member.

2. The foldable portable organizer desk of claim 1, comprising a base member recessed area formed on the rear surface of the base member, the pair of leg members attached within a bottom surface of the base member recessed area, wherein the pair of leg members filling the base member recessed area to form a smooth rear surface of the base, member when the pair of leg members are folded up and stored within the base member recessed area.

3. The foldable portable organizer desk of claim 1, wherein a rear edge of the folding member is hingely coupled to a rear edge of the base member.

4. The foldable portable organizer desk of claim 1, wherein the base member and the folding member have a same outer perimeter.

5. The foldable portable organizer desk of claim 1, wherein the base member and the folding member have a same geometric shape and a same outer perimeter.

6. The foldable portable organizer desk of claim 1, comprising a handle attached to a front edge of the folding member.

7. The foldable portable organizer desk of claim 1, wherein the at least one holding container comprises a plurality of holding containers, wherein a first holding container of the plurality of holding containers is formed in the folding member recessed area and a pair of exterior holding containers of the plurality of holding containers is formed on an exterior surface of the folding member.

8. A foldable portable organizer desk, comprising:
- a rectangular base member having a flat front surface;
- a pair of leg members hingely coupled to a rear surface of the rectangular base member;
- a rectangular folding member coupled to the rectangular base member;

a hinge securing a rear edge of the rectangular folding member to a rear edge of the rectangular base member;

a folding member recessed area formed in an interior ace of the rectangular folding member;

at least one holding container formed in the folding member recessed area;

a base member recessed area formed on the rear surface of the rectangular base in member, the pair of leg members attached within a bottom surface of the base member recessed area, wherein the pair of leg members filling the base member recessed area to form a smooth rear surface of the rectangular base member when the pair of leg members are folded up and stored within the base member recessed area; and a locking mechanism securing the folding member to the base member, wherein the locking mechanism comprises:

a first locking member formed on a front interior area of the folding member, wherein the first locking member is a male connector;

a second locking member formed on a front interior area of the base member, wherein the second locking member is a female connector; and a release button formed flush on a front edge of the base member.

9. The foldable portable organizer desk of claim 8, wherein the rectangular base member and the rectangular folding member have a same outer perimeter.

10. The foldable portable organizer desk of claim 8, comprising a handle attached to a front edge of the rectangular folding member.

11. The foldable portable organizer desk of claim 8, wherein the at least one holding container comprises a plurality of holding containers, wherein a first holding container of the plurality of holding containers is formed in the folding member recessed area and a pair of exterior holding containers of the plurality of holding containers is formed on an exterior surface of the rectangular folding member.

12. A foldable portable organizer desk, comprising:

a base member having a flat front surface;

a pair of leg members hingely coupled to a rear surface of the base member;

a folding member coupled to the base member, wherein the base member and the folding member have a same geometric shape and a same outer perimeter;

a hinge securing a rear edge of the folding member to a rear edge of the base member;

a folding member recessed area formed in an interior surface of the folding member;

at least one holding container formal in the folding member recessed area;

a base member recessed area formed on the rear surface of the base member, the pair of leg members attached within a bottom surface of the base member recessed area, wherein the pair of leg members tilling the base member recessed area to form a smooth rear surface of the base member when the pair of leg members are folded up and stored within the base member recessed area; and a locking mechanism securing the folding member to the base member, wherein the locking mechanism comprises:

a first locking member formed on a front interior area of the folding member, wherein the first locking member is a male connector;

a second locking member formed on a front interior area of the base member, wherein the second locking member is a female connector; and a release button formed flush on a front edge of the base member.

13. The foldable portable organizer desk of claim 12, comprising a handle attached to a front edge of the folding member.

14. The foldable portable organizer desk of claim 12, wherein the at least one holding container comprises a plurality of holding containers, wherein a first holding container of the plurality of holding containers is formed in the folding member recessed area and a pair of exterior holding containers of the plurality of holding containers is formed on an exterior surface of the folding member.

* * * * *